US007607653B2

(12) United States Patent
Shinn et al.

(10) Patent No.: US 7,607,653 B2
(45) Date of Patent: Oct. 27, 2009

(54) SYSTEMS AND METHODS FOR MAINTAINING THE DENSITY OF GROUPED SHEET ARTICLES

(75) Inventors: Frank Shinn, Fuquay Varina, NC (US); Edward J. Kapturowski, Apex, NC (US); Walter S. Conard, Lake Villa, IL (US)

(73) Assignee: Bowe Bell + Howell Company, Durham, NC (US)

( * ) Notice: Subject to any disclaimer, the term of this patent is extended or adjusted under 35 U.S.C. 154(b) by 110 days.

(21) Appl. No.: 11/546,552

(22) Filed: Oct. 12, 2006

(65) Prior Publication Data

US 2008/0088076 A1 Apr. 17, 2008

(51) Int. Cl.
*B65H 3/14* (2006.01)
*B65H 1/18* (2006.01)

(52) U.S. Cl. ..... 271/97; 271/96; 271/152; 271/153

(58) Field of Classification Search ..... 271/97, 271/98, 260, 90, 309, 105, 150, 153; 414/795.5; 73/37.7, 1.57
See application file for complete search history.

(56) References Cited

U.S. PATENT DOCUMENTS 3,207,017 A 9/1965 McCain et al.
3,213,670 A * 10/1965 MacGeorge ..... 73/37.6
3,275,118 A 9/1966 McCain etal.
3,545,371 A 12/1970 Reist
3,717,074 A 2/1973 Rasmussen
4,071,997 A 2/1978 Gunther, Jr. et al.
4,078,790 A 3/1978 Stocker
4,217,085 A 8/1980 Ljungberg et al.
4,299,073 A 11/1981 Golicz et al.
4,346,876 A * 8/1982 Guenther et al. ..... 271/11
4,397,459 A * 8/1983 Silverberg et al. ..... 271/94
4,524,691 A 6/1985 Miller
4,541,764 A 9/1985 Govan et al.
4,604,849 A 8/1986 Zemke et al.
4,694,631 A 9/1987 Gunther, Jr.

(Continued)

FOREIGN PATENT DOCUMENTS

DE 34 09 168 A1 9/1985

(Continued)

OTHER PUBLICATIONS

Extended European Search Report issued in European Patent Application No. EP 07 01 7894, dated Feb. 28, 2008.

(Continued)

*Primary Examiner*—Patrick H Mackey
*Assistant Examiner*—Luis Gonzalez
(74) *Attorney, Agent, or Firm*—Jenkins, Wilson, Taylor & Hunt, P.A.

(57) ABSTRACT

Systems and methods are provided for maintaining density and positioning of a grouped sheet articles, such as for feeding of sheet articles from or into the group. One or more pneumatic sensing systems can be used to monitor and control pressure of sheet articles within the group. Dynamic adjustment can be made to the density and position of the sheet articles in the group such as by controlling a motorized belt to move at least a portion of the group of sheet articles in response to an indication to do so from a controller in communication with the pneumatic sensor.

22 Claims, 16 Drawing Sheets

U.S. PATENT DOCUMENTS

| | | | | |
|---|---|---|---|---|
| 4,694,632 | A | 9/1987 | Gunther, Jr. | |
| 4,753,429 | A | 6/1988 | Irvine et al. | |
| 4,775,143 | A | 10/1988 | Arnoldi et al. | |
| 4,787,192 | A | 11/1988 | Gunther, Jr. | |
| 4,958,063 | A | 9/1990 | Hausmann | |
| 5,100,125 | A | 3/1992 | Uplinger et al. | |
| 5,125,214 | A | 6/1992 | Orsinger et al. | |
| 5,154,410 | A | 10/1992 | Baader et al. | |
| 5,230,504 | A | 7/1993 | Schmaling | |
| 5,255,498 | A | 10/1993 | Hotchkiss et al. | |
| 5,414,977 | A | 5/1995 | Cohen | |
| 5,415,068 | A | 5/1995 | Marzullo | |
| 5,417,414 | A | 5/1995 | Belec et al. | |
| 5,449,159 | A | 9/1995 | Belec et al. | |
| 5,524,417 | A | 6/1996 | Iddon | |
| 5,581,972 | A | 12/1996 | Antonelli | |
| 5,737,899 | A | 4/1998 | Supron et al. | |
| 5,802,808 | A | 9/1998 | Lyga | |
| 5,848,518 | A | 12/1998 | Bufalini et al. | |
| 5,860,643 | A | 1/1999 | Moser et al. | |
| 6,041,569 | A | 3/2000 | Freeman et al. | |
| 6,182,962 | B1 | 2/2001 | Leuthold | |
| 6,341,773 | B1 | 1/2002 | Aprato et al. | |
| 6,371,902 | B1 | 4/2002 | Bluemle | |
| 6,398,204 | B1 | 6/2002 | Keane et al. | |
| 6,446,955 | B1 | 9/2002 | Janatka et al. | |
| 6,585,256 | B2 * | 7/2003 | Blackwell et al. | 271/150 |
| 6,615,105 | B2 | 9/2003 | Masotta | |
| 6,915,184 | B2 | 7/2005 | Yates et al. | |
| 6,957,521 | B2 | 10/2005 | Botschek et al. | |
| 7,021,184 | B2 | 4/2006 | Sussmeier et al. | |
| 7,220,093 | B2 | 5/2007 | Overman et al. | |
| 7,396,006 | B2 | 7/2008 | Kapturowski et al. | |
| 2003/0014376 | A1 | 1/2003 | DeWitt et al. | |
| 2004/0035527 | A1 | 2/2004 | Cook | |
| 2004/0255561 | A1 | 12/2004 | Heilman | |
| 2005/0189409 | A1 | 9/2005 | Conrad et al. | |
| 2007/0075475 | A1 | 4/2007 | Kapturowski et al. | |
| 2007/0145659 | A1 | 6/2007 | Kapturowski et al. | |
| 2007/0164496 | A1 | 7/2007 | Kapturowski et al. | |
| 2008/0086983 | A1 | 4/2008 | Kapturowski et al. | |
| 2008/0088083 | A1 | 4/2008 | Kapturowski et al. | |
| 2008/0090713 | A1 | 4/2008 | Kapturowski et al. | |

FOREIGN PATENT DOCUMENTS

| | | | |
|---|---|---|---|
| DE | 3811221 | A1 | 10/1989 |
| DE | 39 38 530 | A1 | 8/1990 |
| DE | 195 43 634 | A1 | 5/1997 |
| DE | 10208583 | A1 | 10/2002 |
| DE | 20320537 | | 10/2004 |
| EP | 0113011 | | 7/1984 |
| EP | 0220124 | | 4/1987 |
| EP | 1770042 | | 4/2007 |
| EP | 17700042 | | 4/2007 |
| EP | 1911602 | | 4/2008 |
| EP | 1911703 | A1 | 4/2008 |
| EP | 1911704 | | 4/2008 |
| EP | 1911708 | | 4/2008 |
| EP | 1911710 | | 4/2008 |
| FR | 2587015 | | 3/1987 |
| GB | 2347897 | | 9/2000 |
| GB | 2399056 | | 9/2004 |
| JP | 61-295934 | | 12/1986 |
| JP | 08207177 | | 8/1996 |
| WO | WO98/46420 | | 10/1998 |
| WO | WO01/56712 | | 8/2001 |

OTHER PUBLICATIONS

"Pneumatiische Positionserfassung," XP-002467367, p. 23-24, Section 2.2.

European Search Report for application EP06018903 dated Mar. 13, 2007.

Extended European Search Report for EP07017896 dated Feb. 22, 2008.

Extended European Search Report dated Jan. 31, 2008 for EP 07020043.1-2211.

Partial European Search Report for EP07017898 dated Feb. 13, 2008.

Office Action Restriction Requirement dated Oct. 30, 2007 for U.S. Appl. No. 11/546,556.

Office Action-non final action dated Jan. 10, 2008 for U.S. Appl. No. 11/546,556.

Notice of Allowance dated Jul. 14, 2008 for U.S. Appl. No. 11/546,556.

Office Action-non final action dated Sep. 25, 2007 for U.S. Appl. No. 11/240,604.

Notice of Allowance dated Dec. 11, 2007 for U.S. Appl. No. 11/240,604.

Patent Withdrawal Notice dated Mar. 28, 2008 for U.S. Appl. No. 11/240,604.

Notice of Allowance dated Apr. 24, 2008 for U.S. Appl. No. 11/240,604.

Communication dated Apr. 22, 2008, issued in Appln. No. 07017894.2-2314.

* cited by examiner 78
78
72A
74
76

78
80
78

SA
79
SA1
O
78
72B
74
80
76

SYSTEMS AND METHODS FOR MAINTAINING THE DENSITY OF GROUPED SHEET ARTICLES

TECHNICAL FIELD

The subject matter disclosed herein relates generally to processing of sheet articles. More particularly, the subject matter disclosed herein relates to systems and methods for maintaining the density of a group of sheet articles, such as for feeding sheet articles from or to the group.

BACKGROUND ART

It is common in many processing technologies to utilize articles automatically fed from a group of articles or to automatically feed articles to or from a group. Feeding systems and stacker systems discussed herein are frequently an integral part of mail piece inserting systems and mail piece sorting systems.

In applications for feeding articles from a group, it can be very desirable to maintain suitable pressure on the group to facilitate and optimize feeding of items from the group. In sheet processing in particular, it is common to provide a group or even a stack of sheet articles and to pull or feed articles from the group either in smaller groups or one by one. Such groups in sheet processing can include, for example, envelopes of any size, insert material for feeding into envelopes or any other suitable sheet material. Groups of sheet articles can be used in sheet processing for feeding of sheet articles from the group or to the group. Envelopes or other sheet articles can be fed from a group of envelopes, which requires pressure maintenance on the group during the feeding process. In a similar manner, envelopes or other sheet articles can be fed to a group of the sheet articles, which also requires pressure maintenance during the feeding process to make room for additional sheet articles. As can be appreciated by those of skill in the art, the use of either a feeding mechanism or a stacker input mechanism imposes pressure control requirements for the group.

When processing envelopes in particular, a conventional technique for processing the envelopes involves holding the group of envelopes where they are all in a vertical orientation in a group and where envelopes can be removed for feeding from one end of the group. As envelopes are removed from the group, it is desirable to keep pressure on the group of envelopes to continue the process. One way to keep pressure on the group of envelopes is to move a belt under the group of envelopes to adjust and maintain desired pressure on the group. Also, some techniques use a mechanism such as a paddle to push against one end of the group of envelopes to apply pressure. In the past, movement of the belt or paddle mechanism has been set to occur during processing of the envelopes at periodic time intervals, such as for example once every 15 milliseconds, to maintain pressure on the remaining envelopes in the group. For a stacker implementation, the process is reversed so that the belt or paddle must be moved every time an envelope is added to the stack to maintain a constant stack pressure.

In light of the above, there remains much room for improvement, particularly with regard to sheet processing, for a more dynamic method for maintaining pressure on a group of articles while processing or removing articles from the group.

SUMMARY

In accordance with this disclosure, novel systems and methods are provided for maintaining the density of grouped sheet articles, such as for feeding of sheet articles from or into the group.

It is an object of the present disclosure therefore to provide novel systems and methods for maintaining the density of grouped sheet articles, such as for feeding of sheet articles from or to the group. This and other objects as may become apparent from the present disclosure are achieved, at least in whole or in part, by the subject matter described herein.

BRIEF DESCRIPTION OF THE DRAWINGS

Preferred embodiments of the subject matter described herein will now be described with reference to the accompanying drawings, of which.

DETAILED DESCRIPTION

Figure 1:
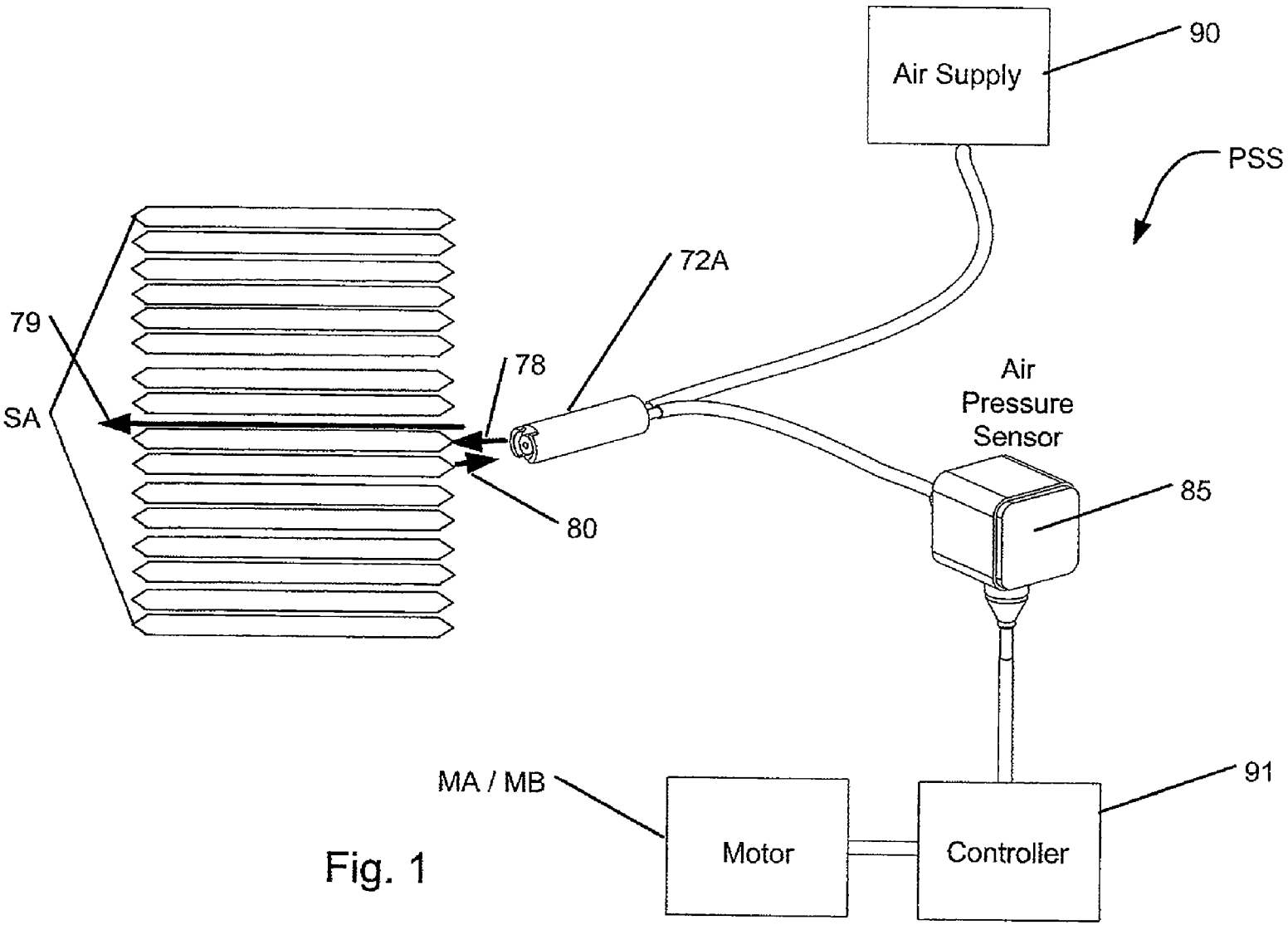
FIG. 1 of the drawings is a schematic view of portions of a system for holding and feeding sheet articles illustrating a pneumatic air pressure sensor system.

In accordance with the present disclosure, novel systems and methods are provided for monitoring, adjusting and maintaining pressure on sheet articles in a group, such as for feeding of sheet articles from the group. The systems and methods described herein can have particular application for use in sheet processing such as, for example, mail inserting systems, mail sorting systems, and any other sheet processing systems or methods utilizing a group of sheet articles.

The term "sheet article" is used herein to designate any sheet article, and can include, for example and without limitation, envelopes, sheet inserts folded or unfolded for insertion into an envelope or folder, and any other sheet materials.

Two common devices, used in mail inserters and mail sorters that feed or stack sheet articles, are envelope feeders and envelope stackers respectively. Devices that feed or stack sheet articles require that the group of sheet articles maintain a pressure against the front section of the feeder or stacker at the location or point where the article is either extracted or inserted. For a feeder, the pressure insures that the envelope is in a position where the feeding mechanism can acquire the envelope in order to "pull" it out of the group. The pressure needs to be controlled since if the pressure is too light, the envelope will not be engaged by the feeder. If the pressure is too high, the feeder may not be able to extract the envelope from the group or more than one envelope will be extracted. For a stacker, the pressure insures that the group of envelopes is pressed against the front face where each envelope is inserted into the stack. The proper pressure ensures that the group of envelopes is not leaning forward or backward and will exert sufficient pressure on the newly arriving envelope to assist in a controlled stop. The controlled stop results from the friction between the newly arriving envelope and the group of envelopes plus the side wall. If the pressure is too high, the friction will be too great, and the new envelope will not be fully added to the stack resulting in poor stack quality, all envelopes not registered against the side wall, or a jam due to little or no insertion into the group.

As disclosed below, the pressure exerted by a group of sheet articles does not have to be measured directly. An air nozzle and air back pressure measurement device can be used to measure the density of the group of sheet articles by sensing the amount of air reflected back to and through the air nozzle by the group of sheet articles instead of the air passing into or through the group of sheet articles. Those skilled in the art may use a variety of terms to relate the pressure that a group of sheet articles may exert on the extraction or insertion point in a sheet article feeder or stacker to the density of the group. The pressure that a group of sheet articles exerts is directly related to the density of the group and can be determined by measuring the amount of air reflected back to the sensor. The amount of air reflected back to the air nozzle is affected by the amount of air that can be forced into or through the group of sheet articles by an air nozzle.

Figures 2A, 2B, 2C:
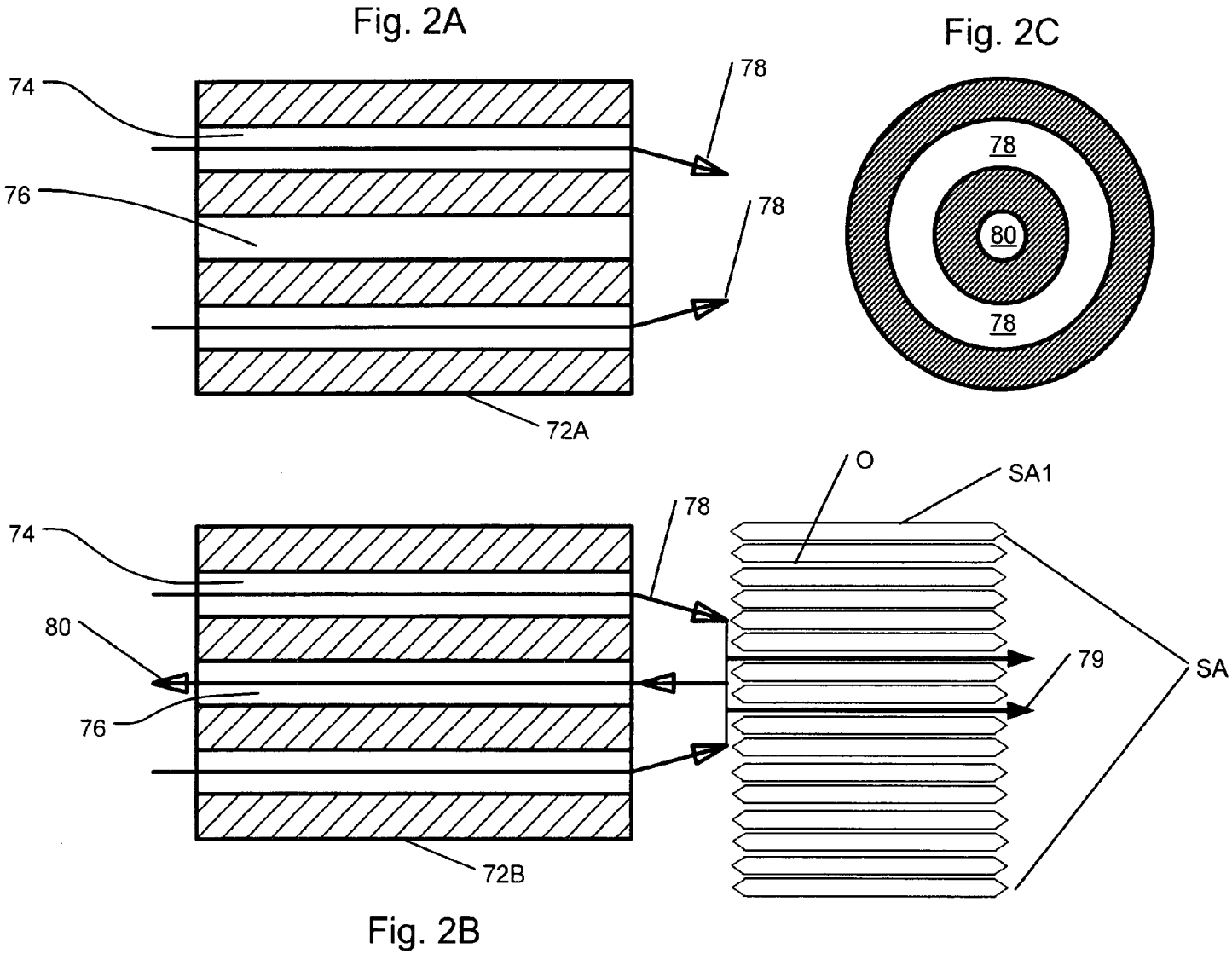
FIGS. 2A, 2B and 2C of the drawings are sectional views of an air nozzle that can be used according to one aspect of the present disclosure and showing air flow through the air nozzle.

This section describes a pneumatic sensing system that can be used on a variety of sheet article feeders or sheet article stackers to enable the control of the pressure exerted on the feeding or stacking mechanism by a group of sheet articles. One possible representation of a feeding or stacking mechanism that is operable with the pneumatic sensor system is shown in FIGS. 3 through 8. Other possible representations may exist as those skilled in the art are aware of or could design. A pneumatic sensing system as shown in FIG. 1 can be used that includes air nozzle 72A, a sensor 85 for measuring the pressure of air passing to sensor 85 from air nozzle 72A, and an air supply 90. Second air nozzle 72B can be part of another, complete pneumatic sensing system PSS with an identical or similar sensor and air supply. Air supply 90 can provide outgoing air 78, that can be in a stream, through air nozzle 72A that is directed at a group of sheet articles SA. Some of air stream 78 can pass through the group as indicated by escape air 79, and some of air stream 78 can be reflected back as indicated by reflected air 80, that can also be in a stream. Reflected air 80 can pass into air nozzle 72A where it is directed to air pressure sensor 85. As shown in FIGS. 2A, 2B and 2C and as known to those familiar with pneumatic sensors, air nozzle 72A can have two air passages therethrough wherein an inner, peripheral air passage 74 can act as a conduit for blowing air therethrough in a direction toward an object. A central air passage 76 can be defined centrally through air nozzle 72A for passage of air therethrough in an opposite direction that has been reflected by an object such as object O in FIG. 2B. Object O for the example described is the side edge of a stack of sheet articles SA. In accordance with the present disclosure, air 78 can be blown through peripheral air passage 74 of air nozzle 72A against the side of a group of sheet articles. The pressure of reflected air 80 as reflected by the group of sheet articles can return through central air passage 76 of air nozzle 72A and be measured by sensor 85. The measurement of air pressure of reflected air 80 can indicate the density or pressure of sheet articles in the group. The difference in the pressure of outgoing air 78 and reflected air 80 is affected by the density of the stack of sheet articles SA. The lower the density of the stack of sheet articles, the more that escape air 79 will escape through the group or out the top and bottom of the group. Since the amount of escape air 79 is proportional to the group density and is a measure of the pressure that the stack will exert on surfaces 60 and 62 (FIG. 5A) or roller 38 and plate 35 (FIG. 5D), the measurement can be used with controller 91 for example to control movement of motors MA and/or MB to adjust the density or pressure of the sheet articles in the group. Table 1 shows one example of current values for the stacks of envelopes used on the sheet article processing machine. Those skilled in the art may develop different values based on testing with a variety of sheet article types and feeder or stacker configurations.

TABLE 1

| Out going air 78 | Reflected air set point 80 | Variation during operation of reflected air 80 | Stack too dense | Stack too loose |
|---|---|---|---|---|
| 20 to 24 psig | 1.3 Pascals | 1.8 to 0.8 Pascals | ≧2.0 Pascals | ≦0.5 Pascals |

For example, controller 91 can cause motors MA and/or MB to move the belts in a direction to cause the sheet articles in a group to pack more tightly together, or controller 91 can cause motors MA and/or MB to move the belts in an opposite direction to cause the sheet articles in a group to be more loosely packed together. An advantage of having two sensor systems is the ability to move sets of belts independently, thereby allowing the system to compensate for skew in the stack of sheet articles. FIG. 2C shows an end view of air nozzle 72A, where output air 78 is supplied by the outside ring and reflected air 80 is returned to the sensor 85 through the center of the nozzle. Those skilled in the art may provide various other configurations such as an oral or diamond. In an alternate approach, a motor can be implemented to drive plate 28 either separately or in conjunction with the belts to make the adjustment in density or pressure of the group of sheet articles.

For that alternative implementation of using pneumatic sensing system PSS to control the operation of a sheet article stacker system, the principles can be identical. One or more sensors such as sensor 85 can be used to sense the density or pressure of sheet articles in the group, and the measurement can be used with controller 91 for example to control movement of motors MA and/or MB to adjust the density or pressure of sheet articles SA in the group. Motors MA or MB can be operated to move any or all of belts B1, and B2 to reduce the density or pressure of sheet articles SA, against input roller 38 and front plate 35, to allow additional sheet articles to be added to the stack. Even when used with a stacker system, the density or pressure of sheet articles SA in some situations may need to be increased. If sheet articles SA are not uniform in length or height, a single sensor 72A may be used where a stacker system is used, but if sheet articles SA are uniform, then two sensors such as sensors 72A and 72B can be employed by adding in slide bars similar to 52 and 54.

Figure 3:
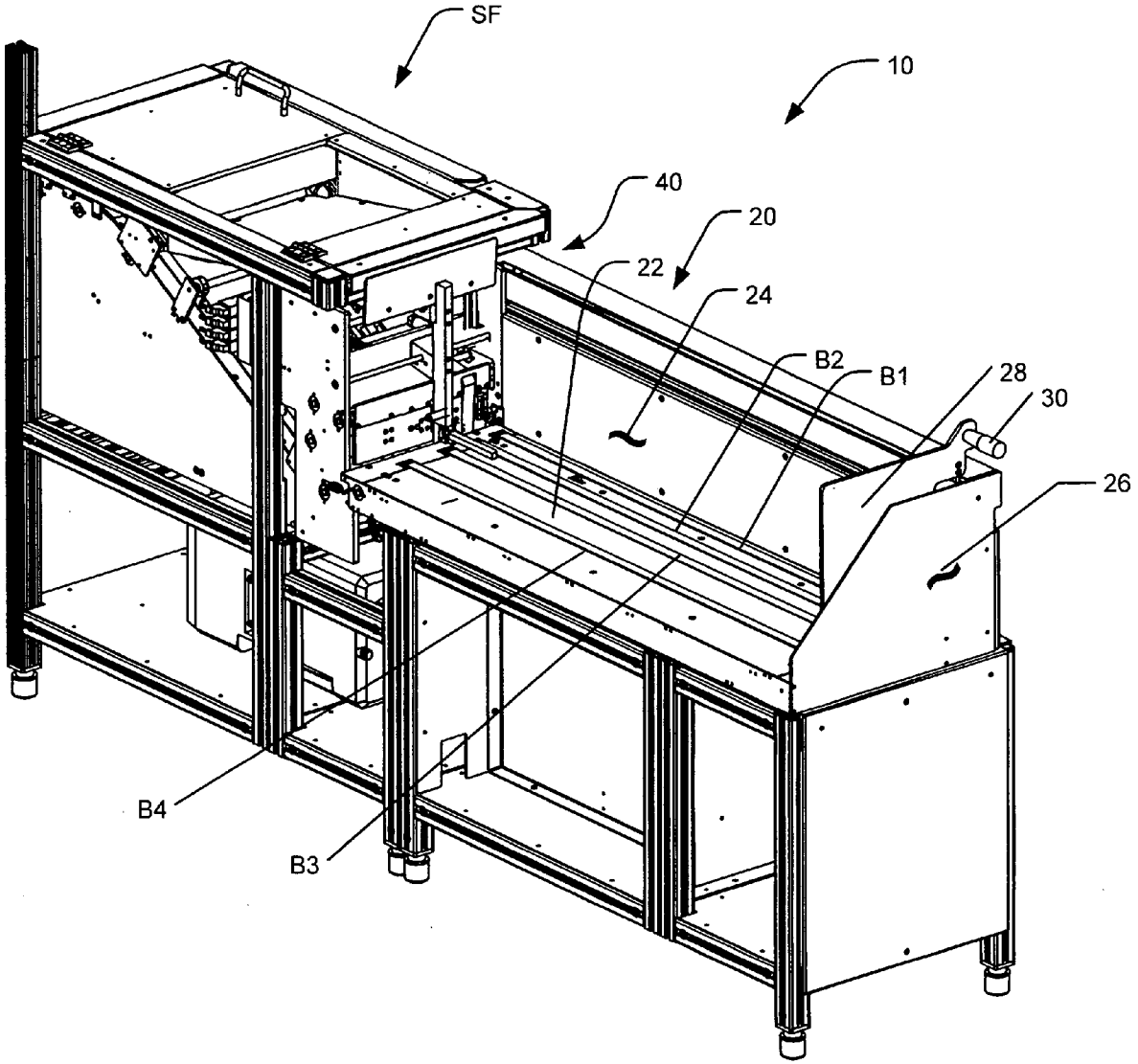
FIG. 3 is a perspective view of a portion of a system for holding and feeding sheet articles according to one aspect of the present disclosure.
Figure 4:
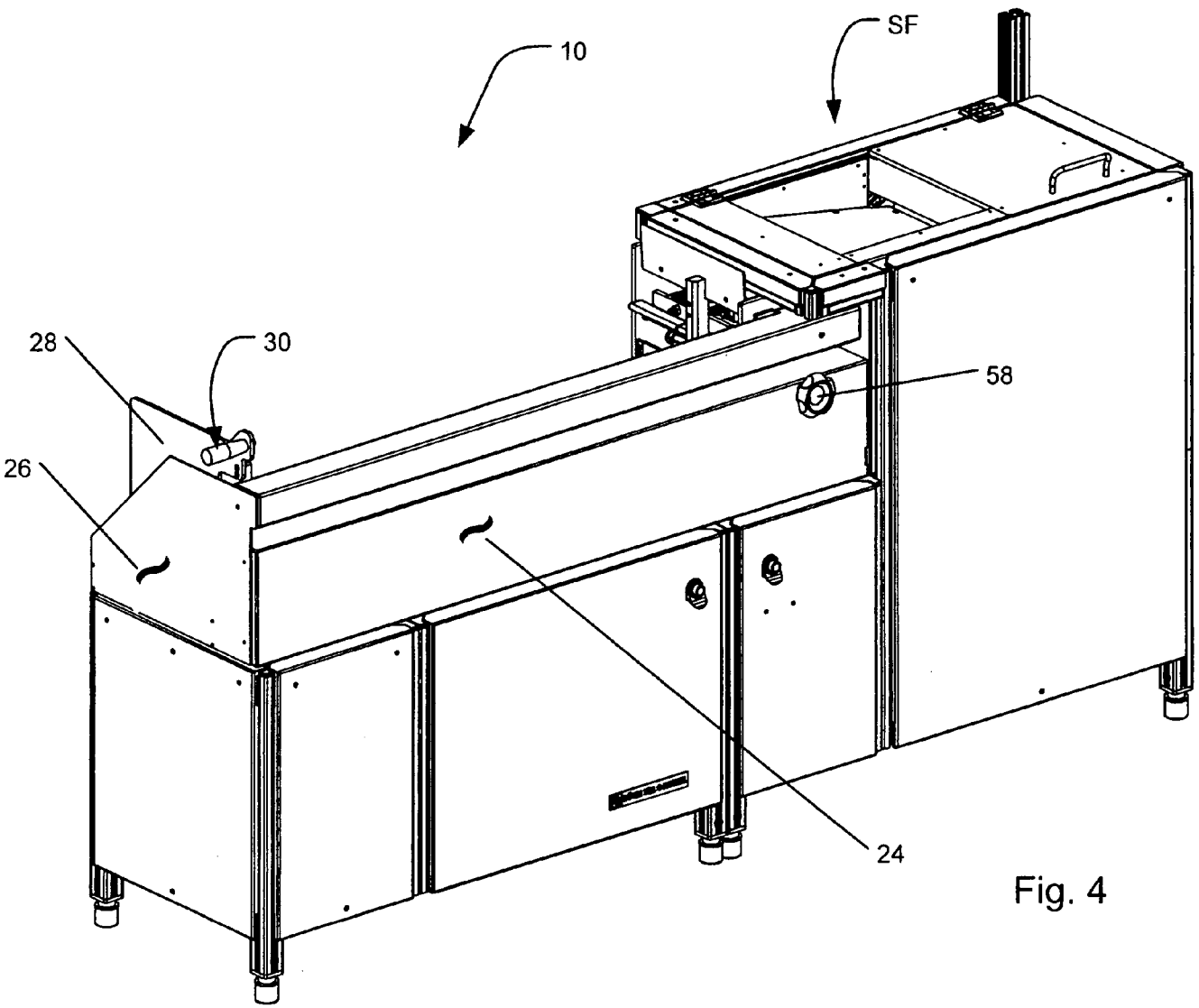
FIG. 4 is a perspective view showing an opposite side of the system for holding and feeding sheet articles shown in FIG. 3.

Referring now to FIG. 3 of the drawings, and according to one aspect of the present disclosure, a system generally designated 10 is shown for maintaining pressure on sheet articles in a group. System 10 can include a support generally designated 20 for supporting a plurality of sheet articles (shown later) in a group. Support 20 can include a surface 22 that can be horizontal and elongated for supporting a plurality of vertically oriented sheet articles in a group on top of surface 22. One or more belts such as belts B1, B2, B3, and B4 can extend at least partially in the direction of surface 22 and can be adapted for moving in a direction toward an end of support 20 as explained in detail further below. Support 20 can also include a side wall 24 that can extend vertically in a direction orthogonal to surface 22 and extend horizontally the distance of support 20. Side wall 24 can be used for registration of sheet articles against side wall 24. An end wall 26 can intersect with an end of side wall 24 and extend vertically away from surface 22. A movable plate 28 can be spring loaded and positioned for pressing against the rear of a group of sheet articles. Plate 28 can include a handle 30 for ease of moving plate 28. FIG. 3 of the drawings shows an operator side view of system 10 and FIG. 4 shows the reverse side view.

One or more groups of sheet articles can be supported on surface 22 of support 20. As shown in one aspect, system 10 as shown in FIG. 3 is configured for supporting two separate groups of vertically oriented sheet articles on surface 22 of support 20 for seriatim feeding of the sheet articles from surface 22 to a sheet feeder such as sheet feeder generally designated SF as explained in detail further below. Those skilled in the art will recognize that sheet articles do not have to be maintained in a particular orientation and can be oriented such that the individual sheet articles in a group are on-edge or vertical, or such that the individual sheet articles in a group are horizontal, where they can be stacked, such as for example from under or over accumulation. The orientation is a function of the infeed location 40 design or the stacker location (not shown) design. Each group of sheet articles can be supported on surface 22 and biased by plate 28 toward a feeding location generally designated 40. At feeding location 40, individual sheet articles from each group can be removed and moved into sheet feeder SF for further processing as explained in detail further below.

Figure 5A:
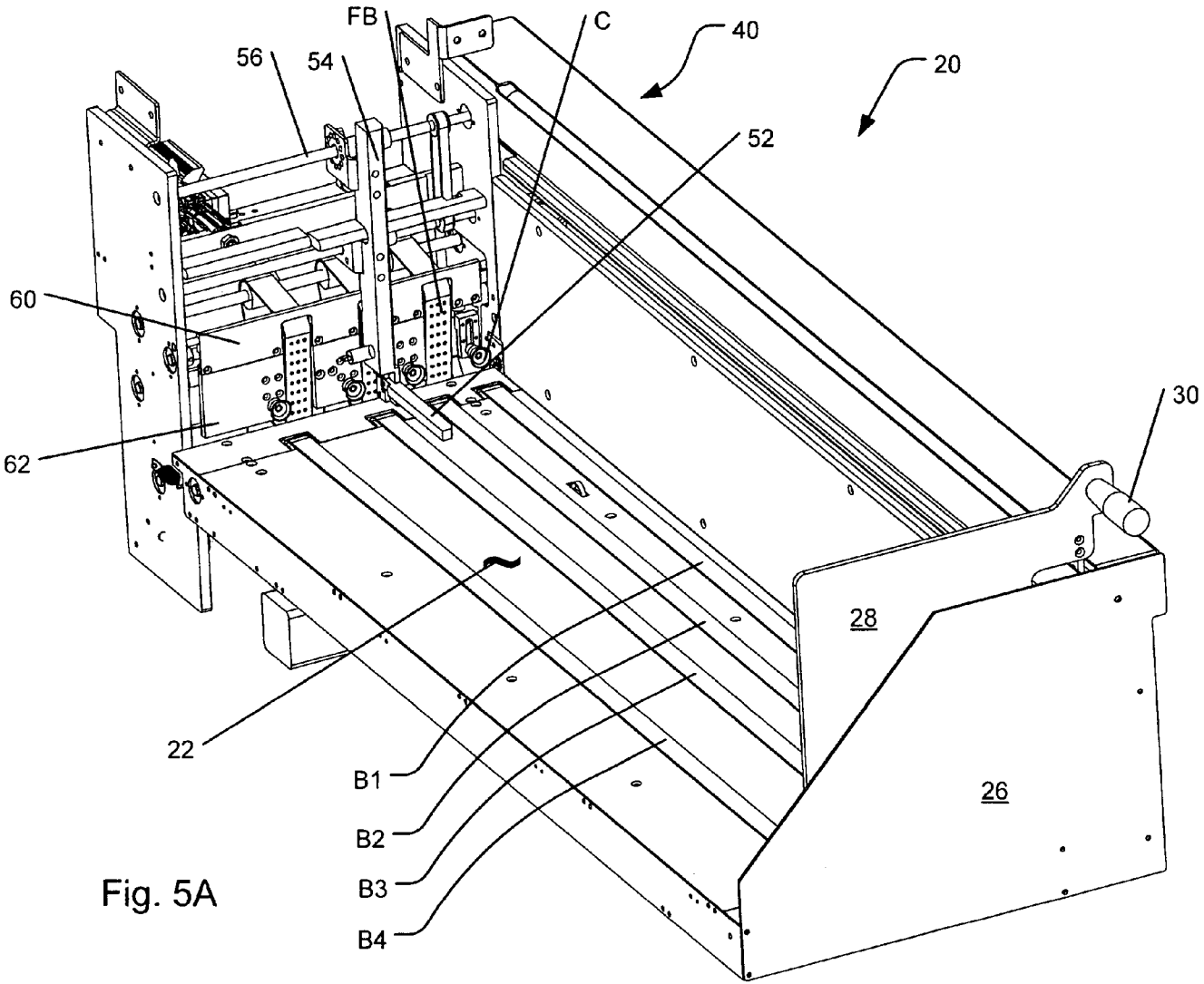
FIGS. 5A, 5B and 5C of the drawings are isolated perspective views of a support portion of a system for holding and feeding sheet articles according to one aspect of the present disclosure with FIGS. 5B and 5C showing support of different sized groups of sheet articles.
Figure 5B:
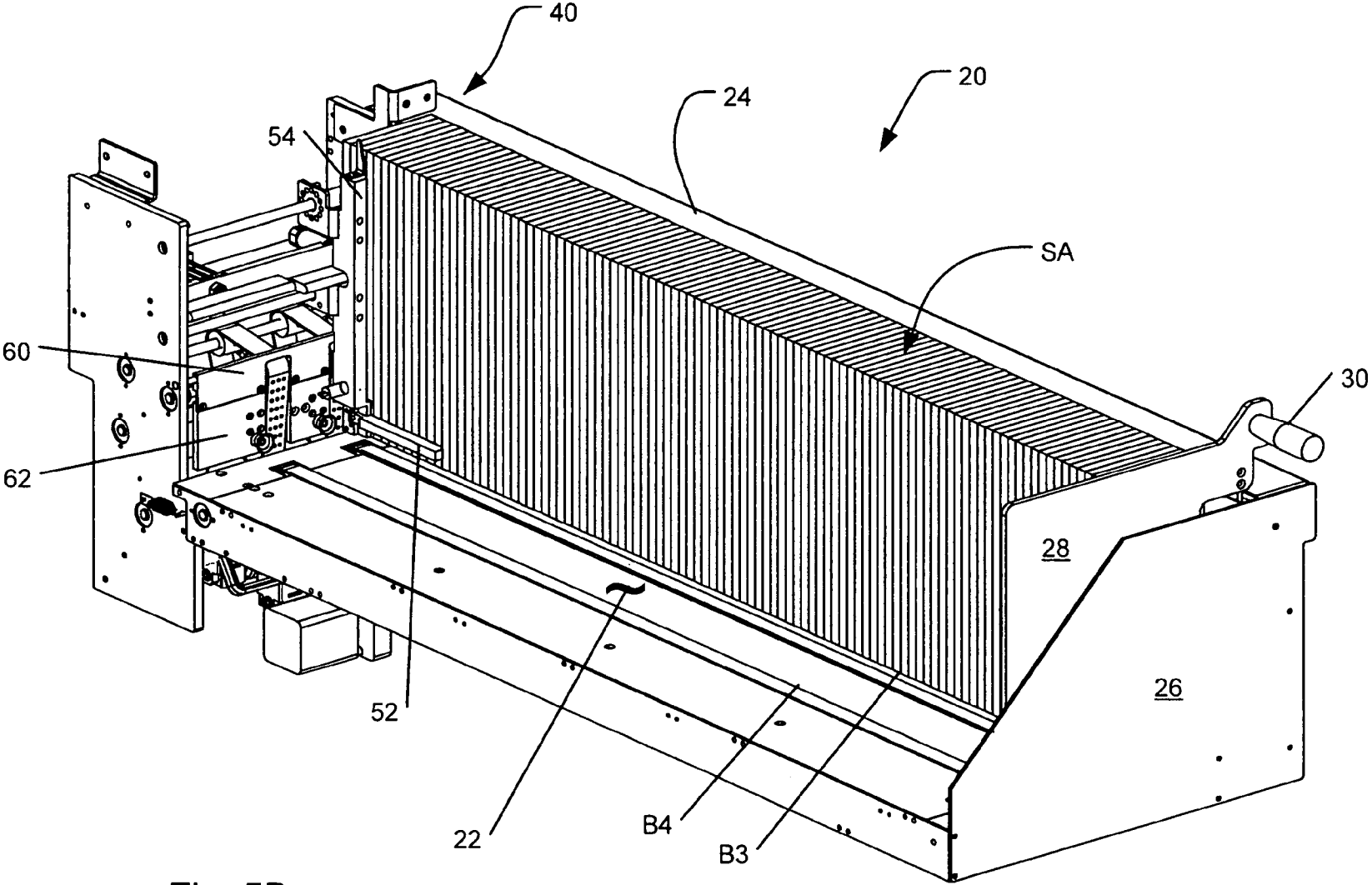

System 10 can use any suitable mechanism or system for moving a group of sheet articles on surface 22. For example, plate 28 can be adapted and used for moving a group of sheet articles on surface 22 instead of any belts as can be appreciated by those of skill in the art. When belts are utilized, just one or more than one belt for moving a group of sheet articles on surface 22 can be utilized. FIG. 5A of the drawings provides a close up view of a portion of system 10 including support 20 configured with belts B1, B2, B3 and B4. As shown in FIG. 5B of the drawings, a group of sheet articles generally designated SA, shown for example as a group of envelopes, is shown supported on surface 22 where sheet articles SA are registered along one side against side wall 24 and biased by plate 28 toward feeding location 40. Those skilled in the art will recognize that plate 28 can be driven to add or remove pressure to a group of sheet articles instead or in addition to the belts.

The group of sheet articles SA is positioned on top of belts B1 and B2 (shown in FIG. 5A) such that belts B1 and B2 can move in a direction toward feeding location 40 in order to maintain a desired pressure of sheet articles SA against one another in the group, which is important for feeding of the sheet articles from the group.

Figure 5C:
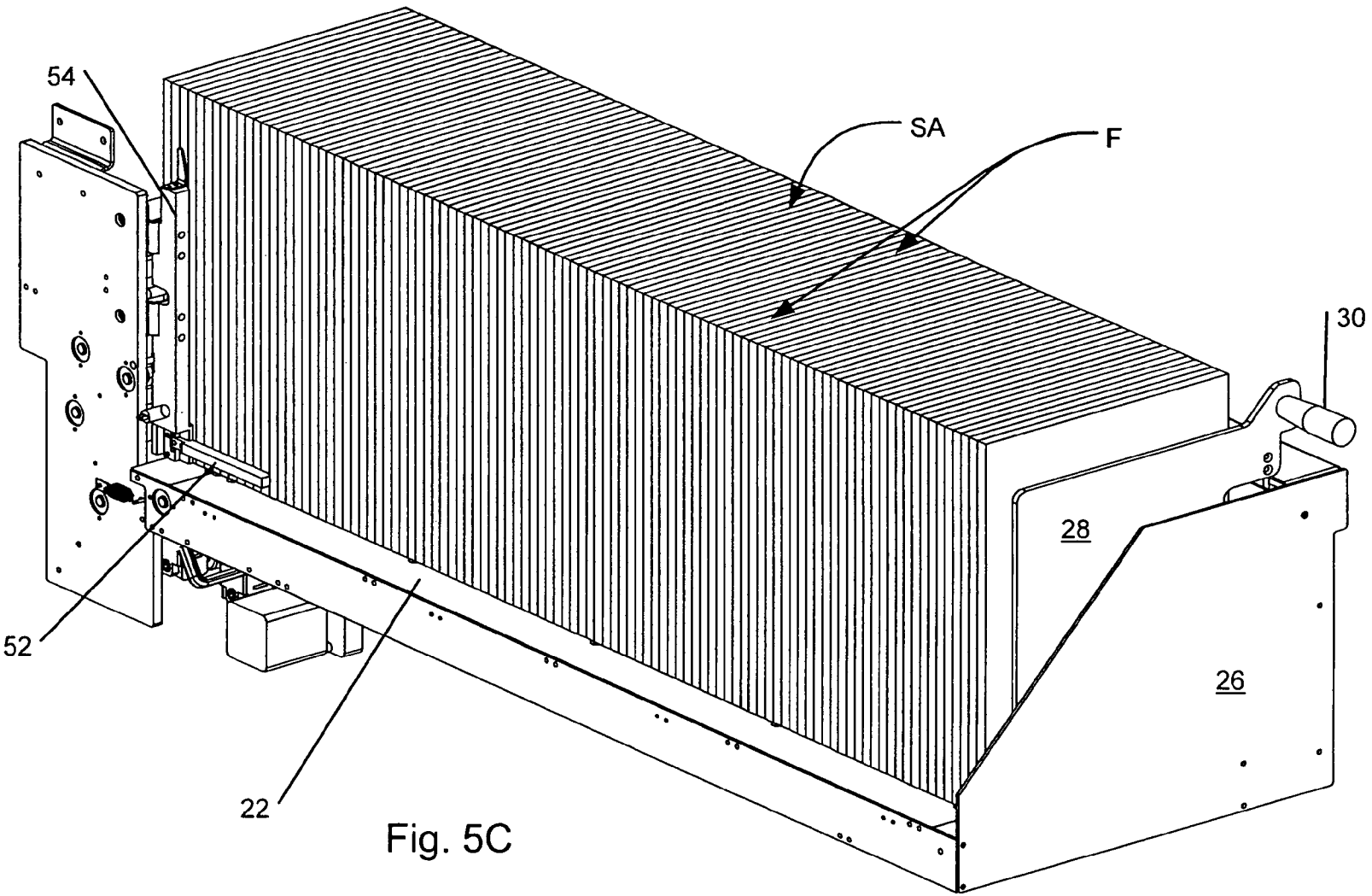
Figure 5D:
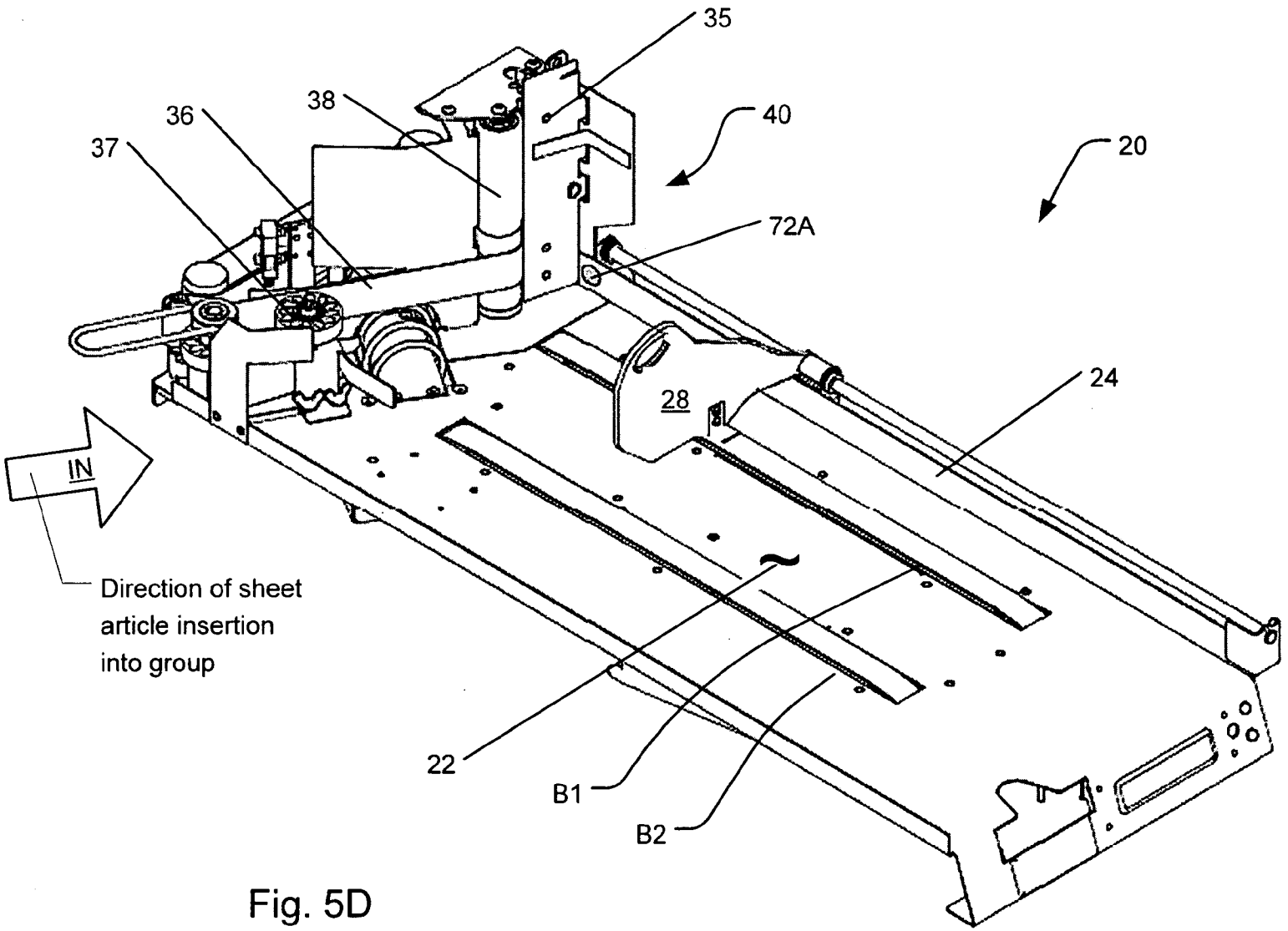
FIG. 5D is a perspective view of a sheet article stacker system used to add sheet articles to a group of sheet articles.

As shown in FIG. 5D, a sheet article stacker system, generally designated SS, can operate similarly, but in an opposite direction. In this aspect, feeding location 40 can be a location for feeding sheet articles such as envelopes to a group on support 22, rather than extracting sheet articles from the group as performed by a feeder. For the example shown, an envelope is inserted into the stack from the left 39 by the compliant roller 37 and the drive belt 36. Pressure control can be maintained against the input roller 38 and front plate 35 in a similar manner using the same support structures 22, 24 and using one or more belts, such as B1 and B2 (additional belts not shown could also be used) and or a driven movable plate such as plate 28. Alternately, plate 28 may be spring loaded to ensure a minimum stack pressure. Belts B1 and B1 and/or plate 28 can be moved as desired each time a sheet article is added to the group based on the sensor operation using an air nozzle 72A as described further below.

Figure 6A:
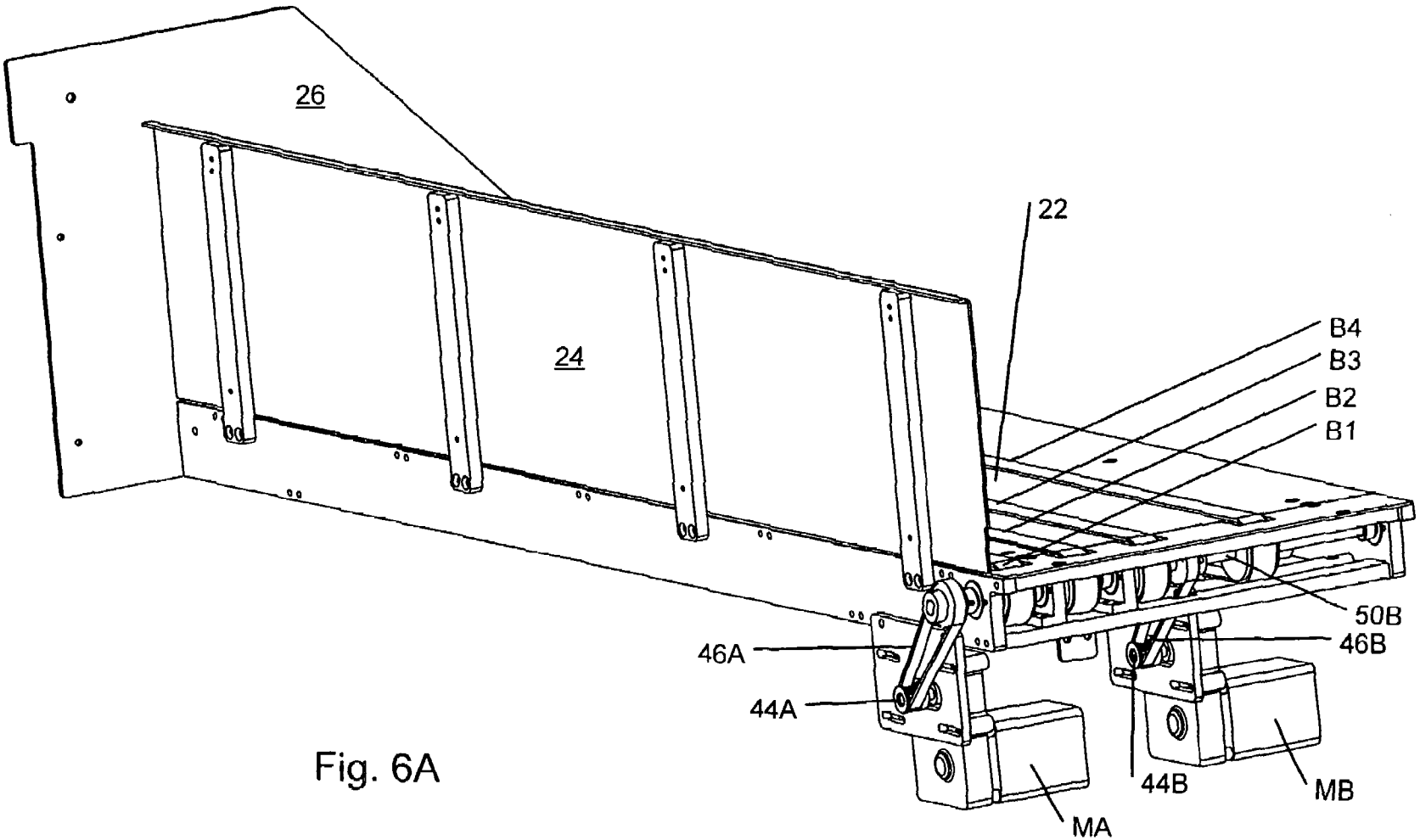
FIG. 6A of the drawings is a perspective view of a portion of a system for holding and feeding sheet articles.
Figure 6B:
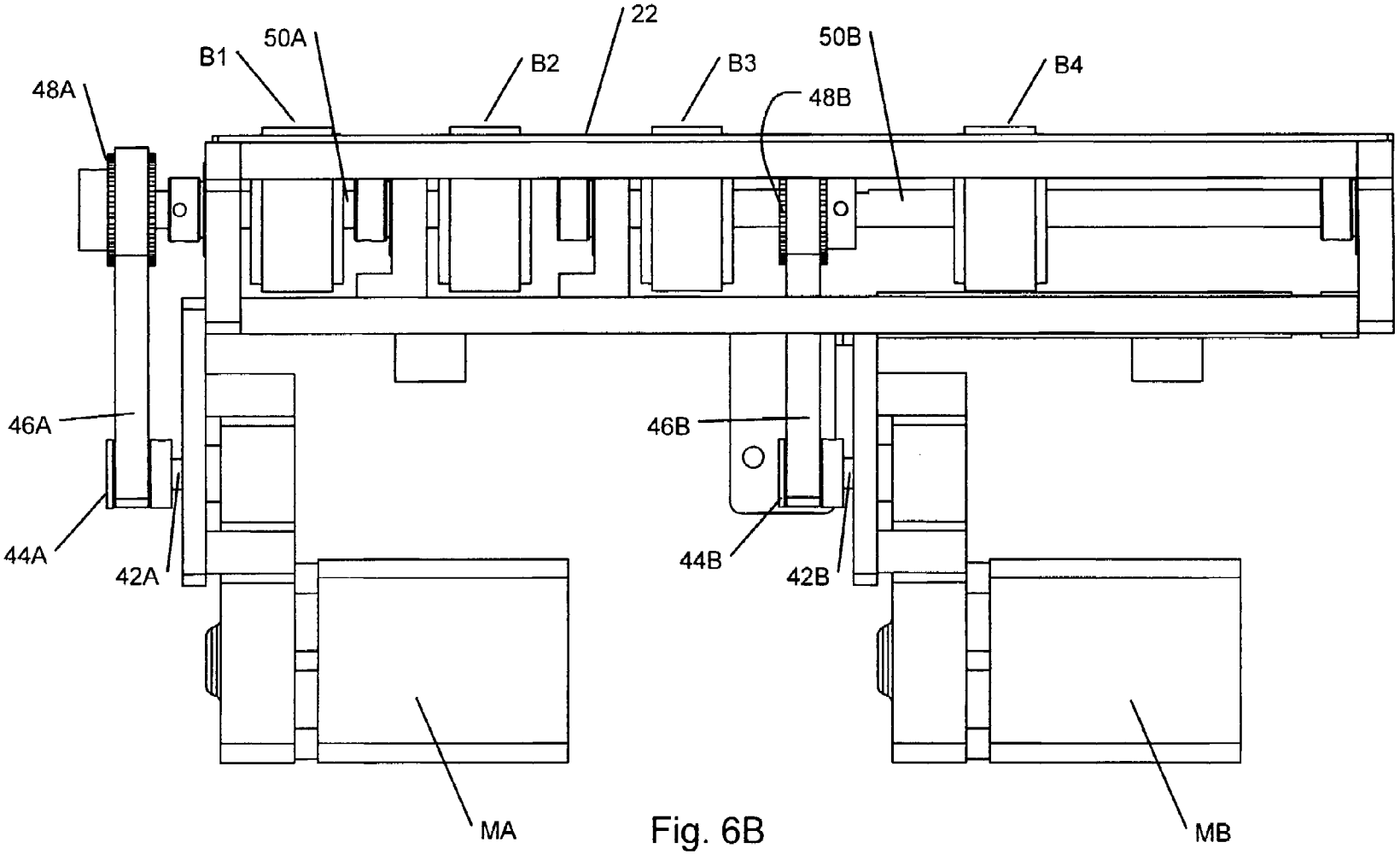
FIG. 6B is an end view of a portion of the system shown in FIG. 6A.

FIGS. 6A and 6B of the drawings show an example of how belts B1, B2, B3 and B4 can be driven. Motor MA can be used for driving belts B1 and B2, and motor MB can be used for driving belts B3 and B4. As best shown in FIG. 6B, motors MA and MB can respectively drive shafts 42A and 42B to turn rollers 44A and 44B. Belts 46A and 46B on rollers 44A and 44B, respectively, can therefore be driven to rotate and turn pulleys 48A and 48B, respectively. Rotation of pulleys 48A and 48B rotates shafts 50A and 50B, respectively. Belts B1 and B2 can be attached on rollers on shaft 50A such that rotation of shaft 50A rotates belts B1 and B2. Similarly, belts B3 and B4 can be attached on rollers on shaft 50B such that rotation of shaft 50B rotates belts B3 and B4. The use of more than two belts and more than one motor provides a differential drive arrangement helpful for processing larger sheet articles, for example large envelopes known as flats. When processing a larger group of sheet articles such as flats F shown in FIG. 6C, the group of flats F can sit on top of belts B1, B2, B3 and B4. In this manner, the use of two motors can address skew that can result for example from the differential in material and weight of an envelope on the bottom side (driven by one set of belts, such as belts B1 and B2) as compared to the flap side (driven by another set of belts, such as belts B3 and B4). As such, motors MA and MB can be controlled and operated selectively at the same or simultaneously different speeds. A side bar 52 (shown in FIGS. 5A and 5B) can be used to assist in aligning a group of sheet articles on surface 22 as they reach feeding location 40. Side bar 52 extends from a side bar base 54 that can be movably attached to a shaft 56 where side bar base 54 can be moved in a transverse direction laterally along shaft 56 by rotation of knob 58 (shown in FIG. 4). Side bar base 54 can therefore be adjusted and positioned as desired for positioning of side bar 52, such as to position side bar 52 between belts B2 and B3 as shown in FIG. 5A or to a far side of surface 22 such as outside of belt B4 as shown in FIG. 5C.

Figure 7A:
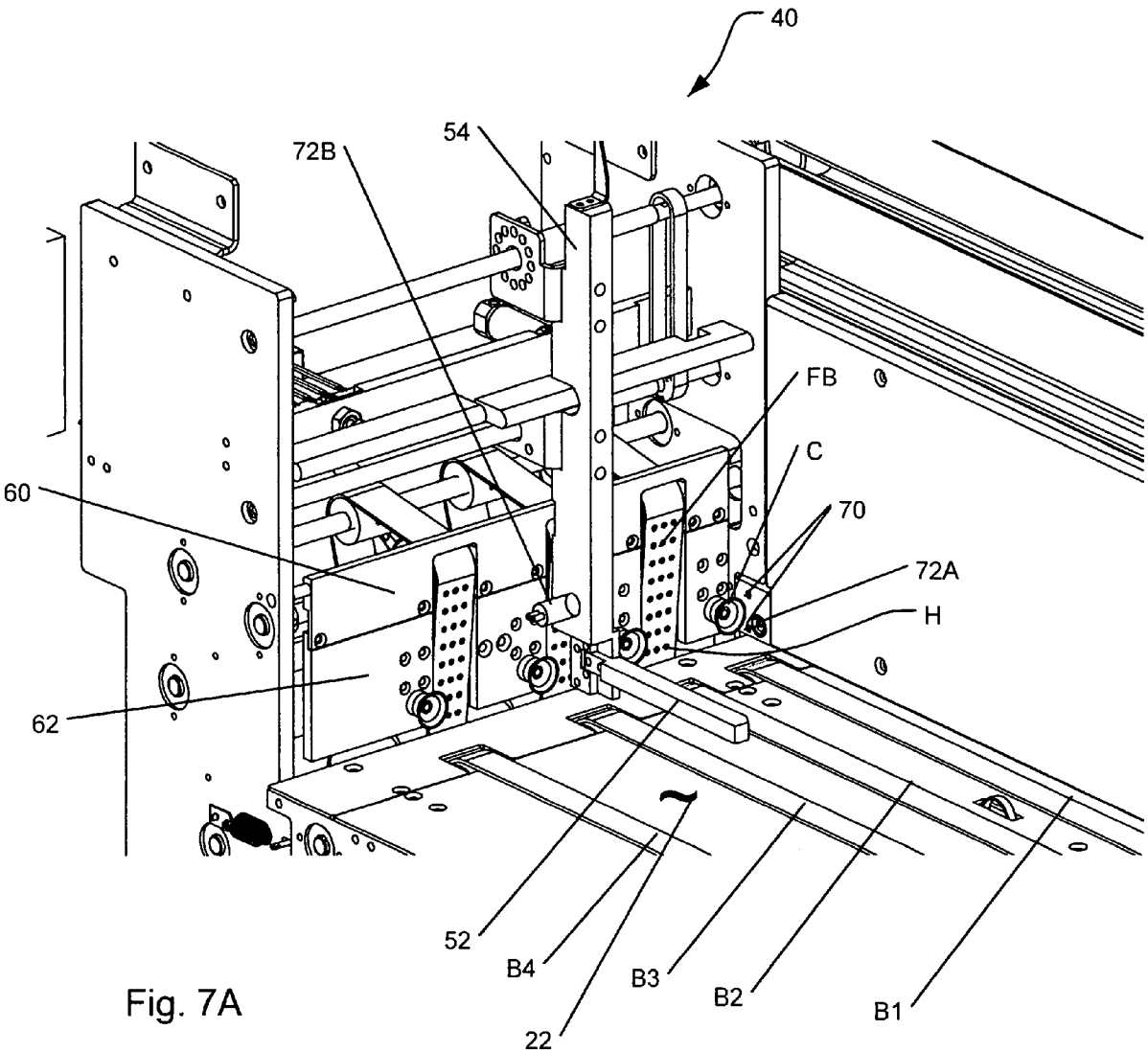
FIGS. 7A and 7B of the drawings are close-up perspective views of portions of a system for holding and feeding sheet articles showing the feeding location and air nozzle(s) location.
Figure 7B:
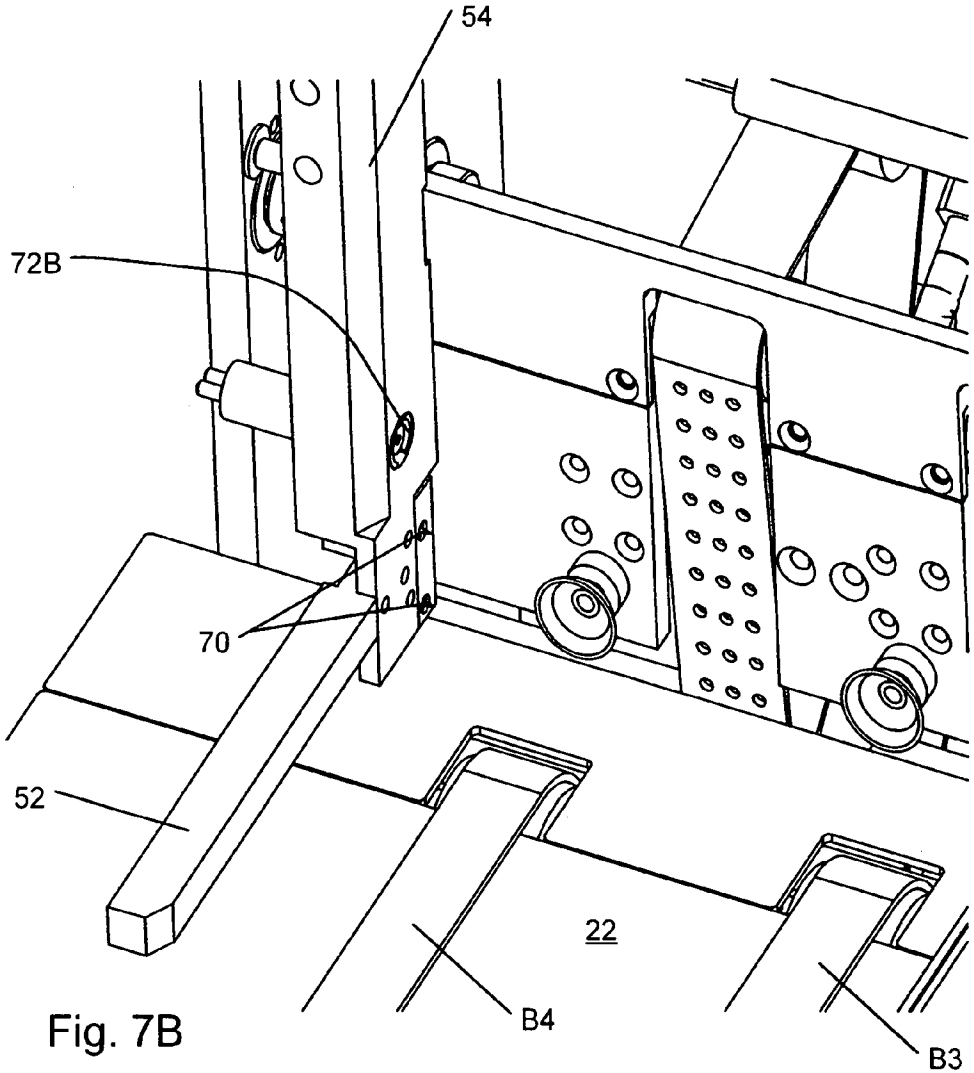

With reference to feeding location 40 and as shown in FIGS. 5A, 7A and 7B of the drawings, one or more feeding belts such as feeding belts FB, can be provided at feeding location 40. Feeding belts can have a plurality of vacuum holes H and can be positioned at the end of surface 22 for feeding of sheet articles from a group as described below. During operation, feeding belt FB can rotate continuously in a downward direction. Feeding belt FB can be positioned and exposed through slots defined in a feeding plate that can have an upper feeding plate portion 60 and a lower feeding plate portion 62. Lower feeding plate portion 62 can be pivotally attached with upper feeding plate portion 60 for pivotal movement of lower feeding plate portion 62 as described in more detail below. One or more suction cups such as suction cups C, can be attached to lower feeding plate portion 62.

As best shown in FIGS. 7A and 7B, separator pins such as pins 70 can be positioned along one or both sides of a feeding end of a group of sheet articles at feeding location 40 and used for facilitating seriatim feeding of a single sheet article from a group as described further below. One pair of separator pins 70 can be positioned proximate suction cup C, and another pair of opposing separator pins can be positioned on side bar base 54. One or more air nozzles such as air nozzles 72A and 72B can be positioned near separator pins 70 for use with the sensing system described in detail further below.

In accordance with the present disclosure, a sensing system such as pneumatic sensing system generally designated PSS can be provided to monitor the density or pressure of a group of sheet articles using an air nozzle such as air nozzle 72A in FIG. 7A for blowing air on against one side of a group of sheet articles on support 22. A second air nozzle 72B as shown in FIG. 7B can be used to blow air against an opposite side of a group of sheet articles on support 22. The use of at least two, opposing air nozzles can be useful for controlling skew of processed sheet articles, especially when the sheet articles being processed are flats. Each air nozzle is connected to its own sensor system PSS and corresponding belt drive motor MA or MB.

Figure 8A:
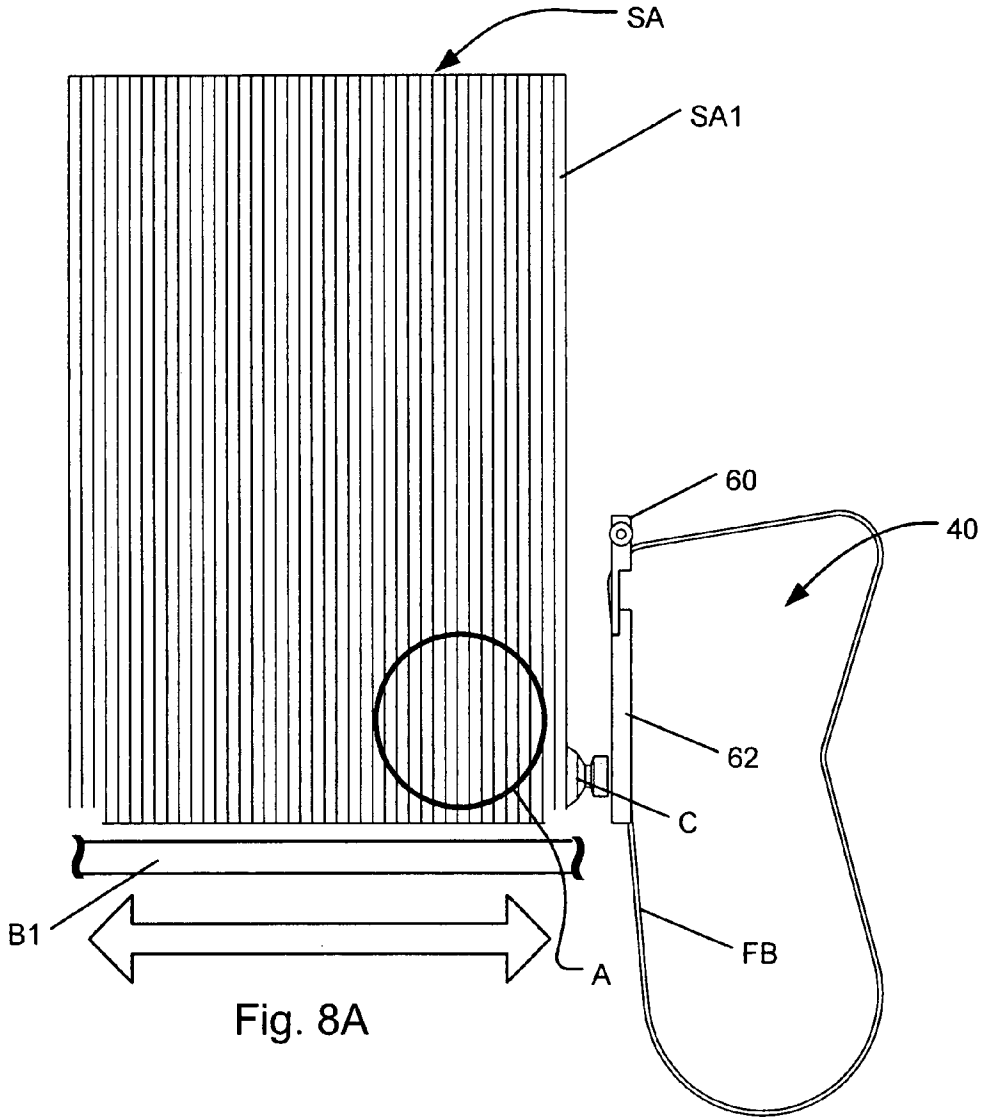
FIGS. 8A, 8B and 8C of the drawings are schematic views illustrating sequential steps in removal of a sheet article from a group of sheet articles according to one aspect of the present disclosure.
Figure 8B:
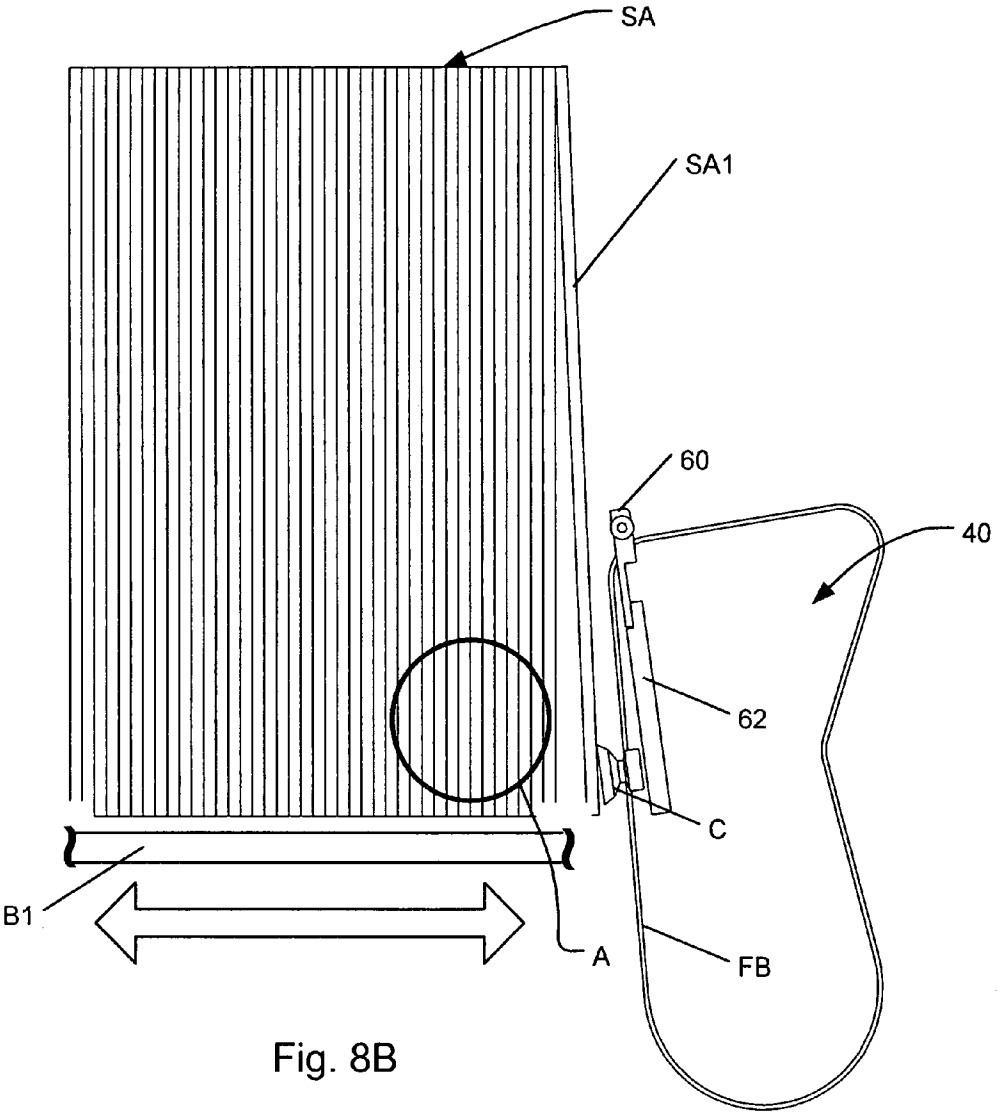
Figure 8C:
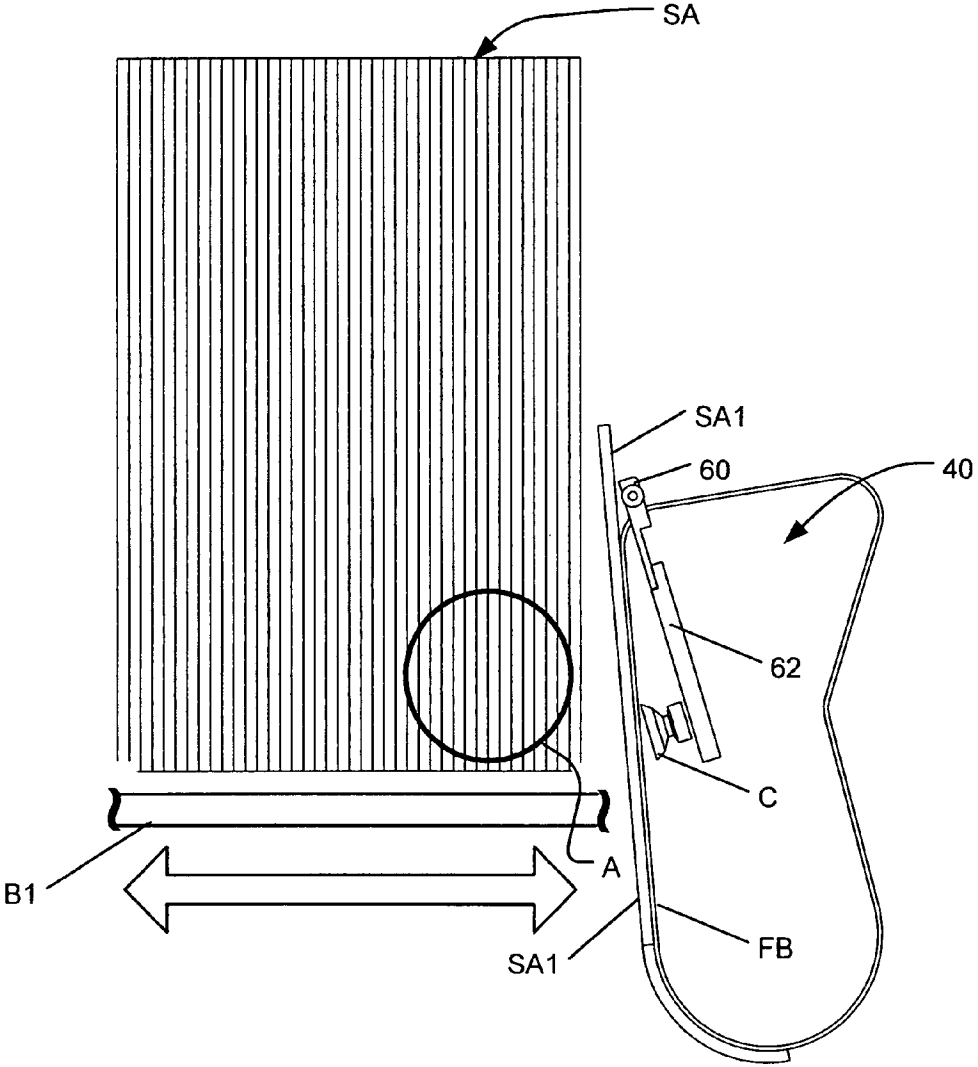

During operation of the feeder and referring to FIGS. 8A-8C, the sensing system can be used to monitor the pressure on surfaces 60 and 62 created by a group of sheet articles SA so that air nozzle 72A (shown previously) can blow air against the side of sheet articles SA such as, for example, at or near area A. Any other suitable area or areas could also be the target for blown air. Air reflected from the sheet articles and passing to the sensor can be used to control movement of belt B1. The controller can be set and configured to cause movement or no movement of belt B1 based upon the air pressure sensed. For example, when the pressure of sheet articles SA against one another in the group is not tight enough, a lower than normal amount or pressure of reflected air passes back to the sensor, and the controller can accordingly cause belt B1 to move toward feeding location 40 in order to increase the pressure of sheet articles against one another in the group. When sheet articles SA are too densely packed together in the group, such that a higher than normal amount or pressure of reflected air passes back to the sensor, the controller can cause belt B1 to accordingly move away from feeding location 40 in order to decrease the pressure of sheet articles against one another in the group. Finally, when the group of sheet articles SA is within a desired range or amount of pressure of sheet articles against one another, such that a normal amount or pressure of reflected air passes back to the sensor, the controller can cause belt B1 to do nothing.

During operation for feeding of one or more sheet articles from the group, at least lower feeding plate portion 62 can move from an unengaged and back position to an engaged and forward position where the suction cups on lower feeding plate portion 62 move forward to engage a sheet article. As shown in the side view illustration of FIG. 8A, lower feeding plate portion 62 is in this forward position where suction cup C with a vacuum pulling through suction cup C engages the end sheet article SA1 in preparation for removal and feeding of sheet article SA1. Sheet article SA1 can be removed from the group by movement of suction cup C away from the group as shown in FIG. 8B. Sheet article SA1 is pulled back against feeding belt FB where a vacuum pulling through feeding belt FB causes sheet article SA1 to stay against feeding belt FB. Movement of feeding belt FB with sheet article SA1 positioned against it further removes sheet article SA1 for feeding as shown in FIG. 8C.

Figure 9:
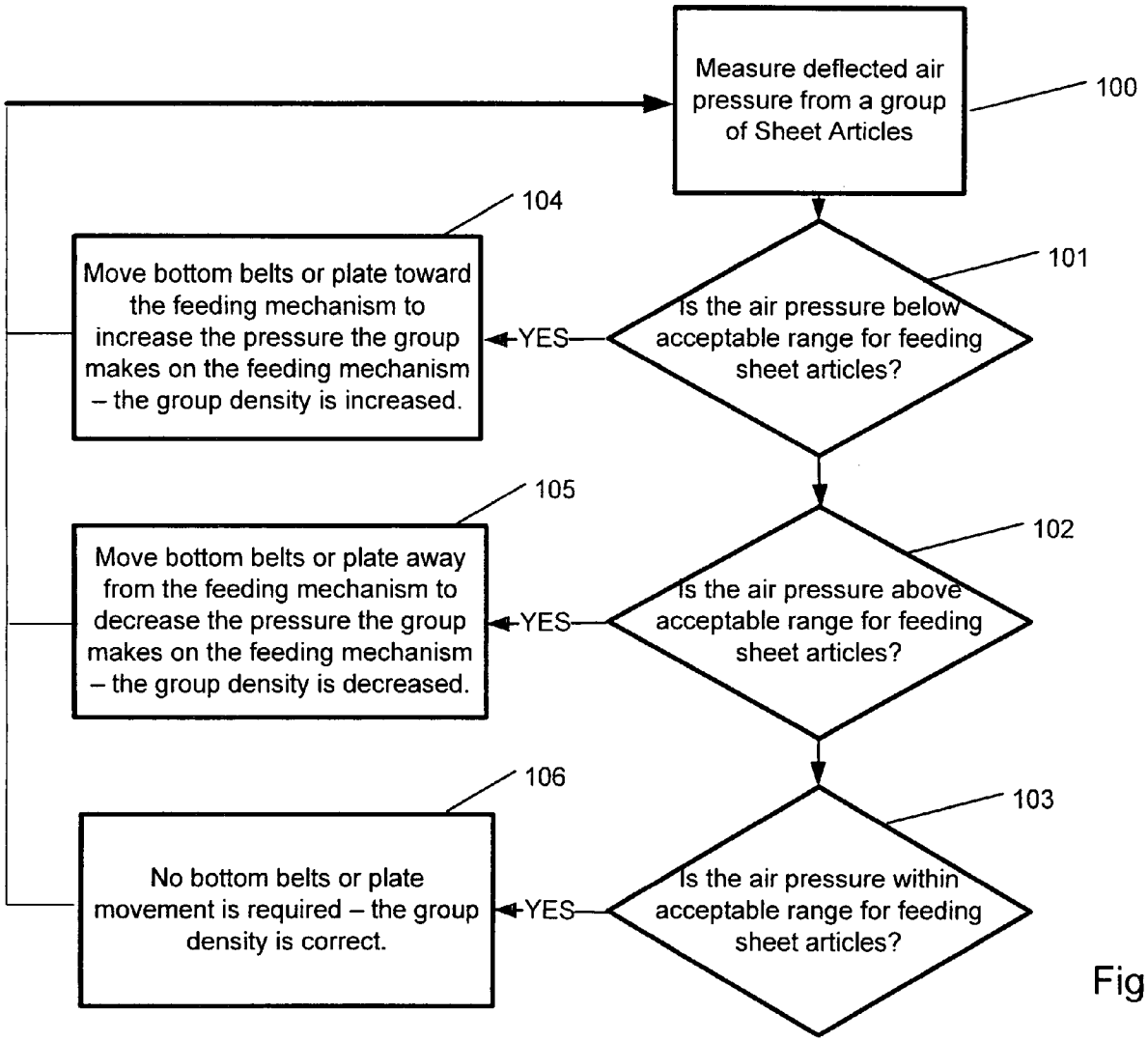
FIG. 9 of the drawings is a flow diagram of the control logic used to change the density of a group of sheet articles.

The pneumatic sensing and control features of the present disclosure can therefore be used at any or all points during feeding of sheet article SA1 to dynamically monitor and control the density and pressure of sheet articles SA against one another in the group and against surfaces 60 and 62 or input roller 38 and front plate 35. Referring to FIG. 9, the density and pressure can be automatically sensed as at 100. When the air pressure is below an acceptable range as at 101, the group is too loosely packed together and adjustments can automatically be made to apply pressure as at 104 to move the stack in the group feeding direction to increase the density of sheet articles in the group. When the air pressure is above an acceptable range as at 102, adjustments can automatically be made to reduce pressure as at 105 to move the stack in a direction opposite from the group feeding direction to reduce the density of sheet articles in the group. When the air pressure is within an acceptable range as at 103, the density is correct and no movement of the group occurs as at 106. Also, the use of more than one pneumatic sensing system allows for independent and automatic monitoring and control of different sides of a group of sheet articles, which can be helpful for controlling skew of sheet articles within the group. When using more than one sensing system, one system can control one or more belts under one side of the group of sheet articles, and another system can simultaneously control one or more belts under another, opposite side of the group of sheet articles.

Where it is desirable to feed sheet articles into a group of sheet articles rather than remove sheet articles from the group, such as with a stacker system as discussed previously, sheet articles SA can be inserted into the group or stack from the side as shown in FIG. 5D. Similar adjustments to the pressure or density of the group can be required for use with a stacker system in order for a sheet article SA1 to be inserted into the stack. Maintaining the pressure or density of the group is important to operation of a stacker since high pressure or density can prevent a sheet article from fully entering the stack and low pressure or density can result in the sheet article bouncing off the support 24 or sustaining damage to the leading edge of the sheet article. The control functions of FIG. 9 can remain the same except that the group can be moved toward or away from the stacker input mechanism.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

The invention claimed is:

1. A density control system for sheet articles in a group, the density control system comprising:

(a) a support for supporting a plurality of sheet articles in a group;

(b) a pneumatic sensor for monitoring density of the group of sheet articles, the pneumatic sensor being configured to detect a pressure of air reflected back from a portion of a group of sheet articles; and (c) a control system for changing density of sheet articles in the group in response to measurements from the sensor.

2. The pressure control system according to claim 1 wherein the pneumatic sensor comprises an air nozzle positioned proximate the support for blowing air toward at least a portion of a group of sheet articles on the support.

3. The pressure control system according to claim 1 wherein the control system comprises a belt configured to contact and move the sheet articles in the group along the support and a motor for moving the belt.

4. A density control system for maintaining desired density of sheet articles in a group, the density control system comprising:

(a) a support for supporting a plurality of sheet articles in a group;

(b) an air nozzle positioned proximate the support for blowing air toward the group of sheet articles on the support;

(c) a pneumatic sensor for monitoring density of the group of sheet articles, the pneumatic sensor configured for measuring pressure of the air blown by the air nozzle and reflected back from the group of sheet articles (d) a movement and control system for moving sheet articles in the group in response to measurements from the pneumatic sensor, the movement and control system comprising a belt for contacting and moving the group of sheet articles along the support and a motor for moving the belt.

5. A method for controlling density of sheet articles in a group, the method comprising:

(a) maintaining a plurality of sheet articles in a group;

(b) monitoring density of the sheet articles in the group with a pneumatic sensor, the monitoring of the density including blowing air against at least a portion of the sheet articles in the group and measuring the blown air that is reflected back by the sheet articles; and (c) controlling the density of the sheet articles in the group in response to the density monitored by the pneumatic sensor.

6. The method according to claim 5 comprising maintaining the sheet articles in an upright position against one another.

7. The method according to claim 5 wherein monitoring the density of the sheet articles in the group comprises using a pneumatic proximity sensor.

8. The method according to claim 5 wherein controlling the density of the sheet articles in the group in response to the density monitored by the sensor comprises moving the group of sheet article in a forward direction for increasing the density of the sheet articles in the group or moving the group of sheet articles in a reverse direction for decreasing the density of the sheet articles in the group.

9. A method for maintaining density of sheet articles in a group, the method comprising:

(a) maintaining a plurality of sheet articles in an upright position in a group;

(b) monitoring density of the sheet articles in the group using a pneumatic sensor to blow air against a portion of the sheet articles in the group wherein the blown air is reflected back by the sheet articles and measured by the pneumatic sensor; and (c) controlling the density of the sheet articles in the group in response to the density monitored by the pneumatic sensor by moving at least a portion of the group of sheet articles in a forward direction for increasing the density of the sheet articles in the group or moving the group of sheet articles in a reverse direction for decreasing the density of the sheet articles in the group.

10. An envelope system for feeding envelopes from or to a group of envelopes, the envelope feeding system comprising:

(a) a support for supporting a plurality of envelopes in a group;

(b) an envelope feeder for removing envelopes from the group or adding envelopes to the group;

(c) an envelope density mechanism for maintaining density of envelopes in the group against each other; and (d) a pneumatic monitor and control system for monitoring density of envelopes against each other in the group and for causing the envelope density mechanism to maintain density of envelopes in the group against each other in response to the monitored density, the monitor and control system comprising:

(i) an air source for blowing air against a portion of the group of envelopes; and (ii) a sensor for sensing air blown against and reflected back towards the air source by the group of envelopes.

11. An envelope feeding system for feeding envelopes from or to a group of envelopes, the envelope feeding system comprising:

(a) a support for supporting a plurality of envelopes in a group where the envelopes are in a vertical orientation;

(b) an envelope feeder for removing envelopes from or adding envelopes to the group;

(c) an envelope density mechanism for maintaining density of envelopes in the group against each other; and (d) a pneumatic monitor and control system for monitoring density of envelopes against each other in the group and for causing the envelope density mechanism to maintain density of envelopes in the group against each other in response to the monitored density, the monitor and control system comprising:

(i) an air source for blowing air against a portion of the group of envelopes; and (ii) a sensor for sensing air blown against and reflected back by the group of envelopes.

12. A method for maintaining pressure of envelopes against each other in a group for feeding of the envelopes from or to the group, the method comprising:

(a) providing an envelope feeding system comprising:

(i) a support for supporting a plurality of envelopes in a group;

(ii) an envelope feeder for removing envelopes from the group or adding envelopes to the group;

(iii) an envelope pressure mechanism for maintaining pressure of envelopes in the group against each other; and (iv) a pneumatic monitor and control system for monitoring pressure of envelopes against each other in the group and for causing the envelope pressure mechanism to maintain pressure of envelopes in the group against each other in response to the monitored density;

(b) monitoring pressure of envelopes against each other in the group by blowing air against a portion of the group of envelopes and sensing air reflected back by the group of envelopes; and (c) controlling the pressure of the envelopes against each other in the group in response to the monitored density of the envelopes in the group.

13. A method for maintaining pressure of envelopes against each other in a group for feeding of the envelopes from or to the group, the method comprising:

(a) providing an envelope feeding system comprising:

(i) a support supporting a plurality of envelopes in a group in a vertical orientation;

(ii) an envelope feeder for removing envelopes from the group or adding envelopes to the group;

(iii) a pressure mechanism for maintaining density of envelopes in the group against each other; and (iv) a pneumatic monitor and control system for monitoring density of envelopes against each another in the group and for causing the envelope pressure mechanism to maintain density of envelopes in the group against each other in response to the monitored density;

(b) feeding envelopes from or to the group of envelopes;

(c) monitoring pressure of envelopes against each other in the group by blowing air against a portion of the group of envelopes and sensing air reflected back by the group of envelopes; and (d) controlling the density of the envelopes against each other in the group in response to monitoring the density of the envelopes in the group by controlling the envelope pressure mechanism to increase or decrease density of the envelopes against each other in the group.

14. A method for maintaining density of envelopes against each other in a group of envelopes, the method comprising:

(a) pneumatically monitoring density of envelopes against each other in a group of envelopes, the density being monitored by blowing air against at least a portion of the group of envelopes and sensing air reflected back by the group of envelopes;

(b) feeding envelopes from or to the group of envelopes; and (c) controlling the density of the envelopes against each other in the group of envelopes in response to pneumatically monitoring the density of the envelopes in the group.

15. The method of claim 14 wherein the envelopes are maintained in the group in a vertical orientation, the density of the envelopes is controlled by moving at least a portion of the group of envelopes to increase or decrease density of the envelopes against each other in the group.

16. A density control system for sheet articles in a group, the density control system comprising:

(a) a support for supporting a plurality of sheet articles in a group;

(b) a pneumatic sensor for monitoring density of the group of sheet articles, the pneumatic sensor configured to detect a pressure of air reflected back from a portion of the group of sheet articles; and (c) a control system for changing density of sheet articles in the group in response to measurements from the sensor, the control system including a belt and a motor for moving the belt, the belt configured to contact and move the sheet articles in the group along the support.

17. The density control system according to claim 16 wherein the pneumatic sensor comprises an air nozzle positioned proximate the support for blowing air toward at least a portion of a group of sheet articles on the support.

18. The density control system according to claim 16 wherein the belt is configured to move the sheet articles along the support in at least one of a first direction or a second direction.

19. A method for controlling density of sheet articles in a group, the method comprising:

(a) maintaining a plurality of sheet articles in a group;

(b) monitoring density of the sheet articles in the group with a pneumatic sensor by blowing air against at least a portion of the sheet articles in the group wherein the blown air is reflected back by the sheet articles and the pressure of the reflected air is measured; and (c) controlling the density of the sheet articles in the group in response to the density monitored by the pneumatic sensor by rotating a belt in contact with sheet articles in at least one of a first direction or a second direction to move the sheet articles along a support in the direction of rotation of the belt.

20. The method according to claim 19 comprising maintaining the sheet articles in an upright position against one another.

21. The method according to claim 19 wherein monitoring the density of the sheet articles in the group comprises using a pneumatic proximity sensor.

22. The method according to claim 19 wherein controlling the density of the sheet articles in the group in response to the density monitored by the sensor comprises moving the group of sheet article in a forward direction for increasing the density of the sheet articles in the group or moving the group of sheet articles in a reverse direction for decreasing the density of the sheet articles in the group.

* * * * *